United States Patent [19]

Grove

[11] Patent Number: 4,762,164

[45] Date of Patent: Aug. 9, 1988

[54] MOLD FRICTION MONITORING FOR BREAKOUT PROTECTION

[75] Inventor: John W. Grove, Cranberry Township, Vanago County, Pa.

[73] Assignee: USX Corporation, Pittsburgh, Pa.

[21] Appl. No.: 87,490

[22] Filed: Aug. 20, 1987

[51] Int. Cl.[4] ..... B22D 11/16

[52] U.S. Cl. ..... 164/150; 164/154

[58] Field of Search ..... 164/150, 154, 416, 451, 164/478; 73/664

[56] References Cited

U.S. PATENT DOCUMENTS

| | | | |
|---|---|---|---|
| 3,741,328 | 6/1973 | Andersson et al. | 177/210 R |
| 3,893,502 | 7/1975 | Slamar | 164/452 |
| 4,219,091 | 8/1980 | Kleinhans | 177/211 |
| 4,532,975 | 8/1985 | Ives | 164/150 |
| 4,615,375 | 10/1986 | Bower et al. | 164/451 |

FOREIGN PATENT DOCUMENTS

| | | |
|---|---|---|
| 0044291 | 1/1982 | European Pat. Off. . |
| 57-32864 | 2/1982 | Japan . |
| 1556616 | 11/1979 | United Kingdom . |

*Primary Examiner*—Nicholas P. Godici
*Assistant Examiner*—Richard K. Seidel
*Attorney, Agent, or Firm*—William F. Riesmeyers, III

[57] ABSTRACT

Apparatus is provided for obtaining a more accurate measure of friction forces on a continuous caster mold. The apparatus includes a plurality of vertical force indicating devices, each comprising a set of at least two horizontally spaced load cells forming the load bearing connection between the mold and a frame for support of the mold. A member bearing on the load cells in each set is slidably mounted in a track to reduce the effect of lateral forces on the load cells due to imbalance or tilting of the mold while the mold is oscillated during the casting operation.

16 Claims, 2 Drawing Sheets

MOLD FRICTION MONITORING FOR BREAKOUT PROTECTION

BACKGROUND OF THE INVENTION

This invention relates to apparatus in continuous caster mold assembly for measuring friction forces on the mold during casting, and particularly to apparatus for minimizing the effects of tilting and imbalance of the mold on measuring devices used to estimate friction forces on the mold.

The process of continuous casting involves pouring molten metal into an open-ended mold having liquid cooled mold walls. A solidified skin forms adjacent to the mold walls while the metal is in the mold. The partially solidified casting is continuously withdrawn from the mold and passes through roll containment racks where it is spray cooled until complete solidification is obtained. The mold is oscillated in reciprocating fashion back and forth in the direction of casting so as to reduce friction between the mold walls and the skin formed adjacent thereto. Excessive friction forces cause defects in the casting and in severe cases results in tearing leading to a breakout of molten metal through the skin below the mold. Breakouts require shutdown and extensive repair or replacement of the roll containment racks before resuming caster operation. It is known to monitor friction forces in the mold during casting and to vary the cooling rate, speed of casting and other factors in order to avoid breakout. Examples of systems for this purpose are disclosed in British Patent 1,556,616, European Patent 44,291, U.S. Pat. No. 3,893,502 and Japanese Kokai J57032864. However, it has been difficult to obtain an accurate measure of such friction forces, decreasing the effectiveness of breakout avoidance systems based on present measurement apparatus. One of the problems involved is that it is difficult to separate the friction forces from other dynamic effects occurring during casting. These dynamic effects are quite variable and may not have any relationship to mold friction so that an accurate measure of friction force is not obtained. Various methods have been used for analyzing the indications obtained from load measurement apparatus in an attempt to separate out the dynamic effects and more accurately estimate mold friction. Examples of such methods are disclosed in U.S. Pat. No. 4,532,975 and U.S. Pat. No. 4,615,375. One of the significant dynamic effects involved is tilting and imbalance of the mold as it is oscillated during the actual casting operation. U.S. Pat. No. 4,532,975 and Japanese Kokai J57032864 recognize this factor but do not attempt to correct the influence it may have on friction force measurements. Misalignment and tilting of the mold during oscillation causes lateral forces of varying degree which significantly effect load cell readings. Generally, the load cells are designed to read only the vertical forces. European patent 44,291 discloses load cells that are movable in slots but which are secured in position by screw connection to a support plate. On the other hand, U.S. Pat. Nos. 4,219,091 and 3,741,328 are directed to load cell apparatus permitting lateral expansion and movement of a weighing device. Neither these references, nor any of the other prior art of which Applicant is aware, recognizes the need for counteracting the effect of tilting or misalignment of a continuous caster mold on friction force measurements or suggests a solution of that problem.

Therefore, it is a primary object of this invention to provide apparatus which will minimize the effect of tilting or imbalance of a continuous caster mold on mold friction force measurement made during actual caster operation.

SUMMARY OF THE INVENTION

According to this invention, a continuous caster mold assembly is provided which includes a continuous caster mold, a frame for support of the mold, said mold and frame being oscillatable in unison in a casting direction, and a plurality of vertical force indicating means for indicating the vertical forces exerted by the mold on said frame during the oscillation thereof. The vertical force indicating means includes at least first and second means mounted on one of two adjoining downwardly and upwardly facing surfaces of opposed walls of the mold and the frame for bearing the load therebetween. The first and second means each include a set of at least two load cells spaced in a horizontal direction and a member associated with each load cell adapted for variable deflection in a vertical direction. Means is provided for mounting on the other of said surfaces for guiding slidable movement of the opposed mold walls with respect to the frame in said horizontal direction during the oscillation of the mold. The slidable movement means includes a track means and a horizontal guide member mounted on the variably deflectable member of the load cells in each set so as to cause vertical deflection of said variably deflectable members. The guide member is slidably movable in the track means in said horizontal direction and serves to reduce the effect of lateral forces due to imbalance in oscillation of the mold and more accurately transmit vertical forces to the load cells in each set thereof.

DESCRIPTION OF THE PREFERRED EMBODIMENT

Figure 1:
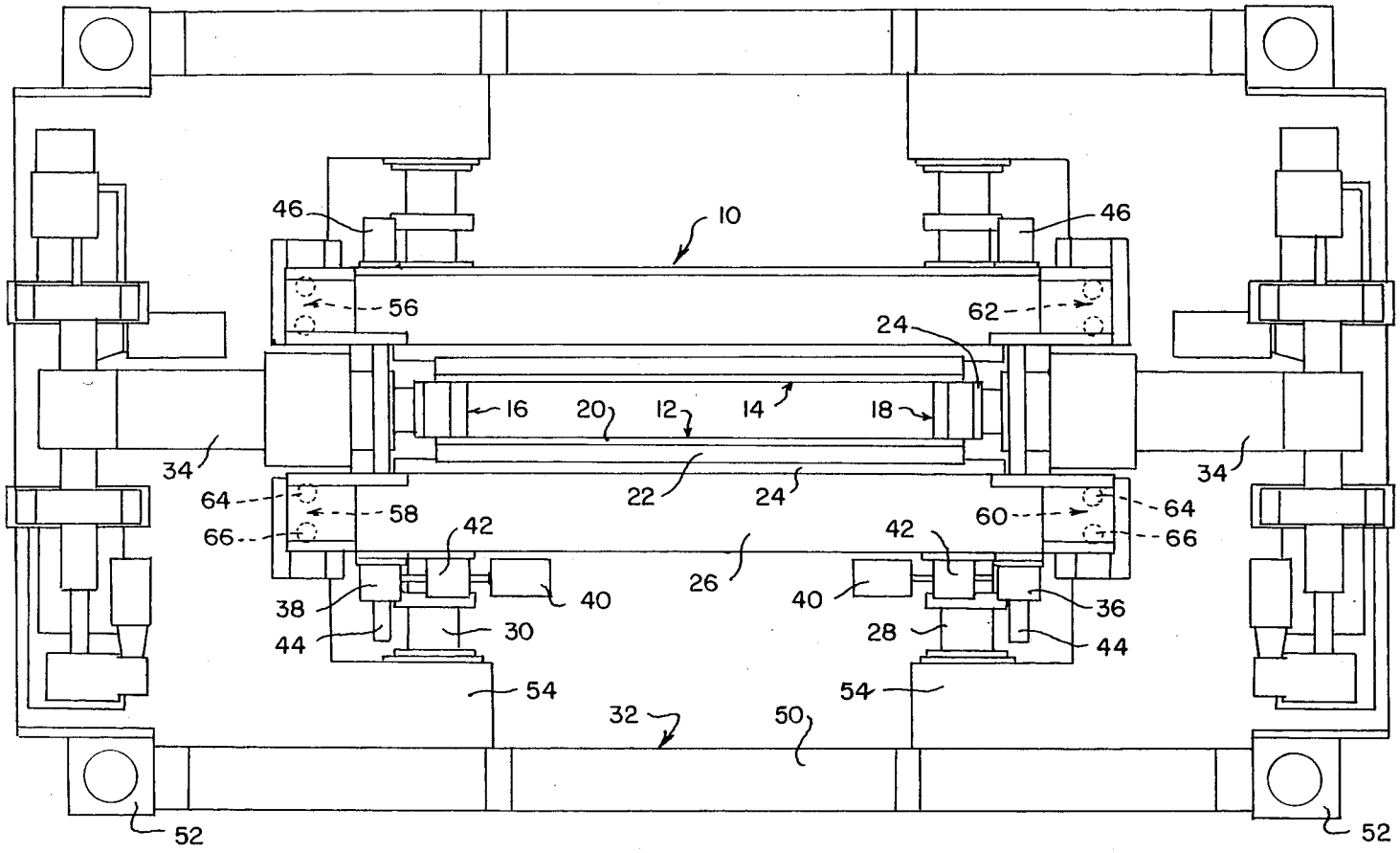
FIG. 1 is a plan view of the improved continuous caster mold assembly of this invention.
Figure 2:
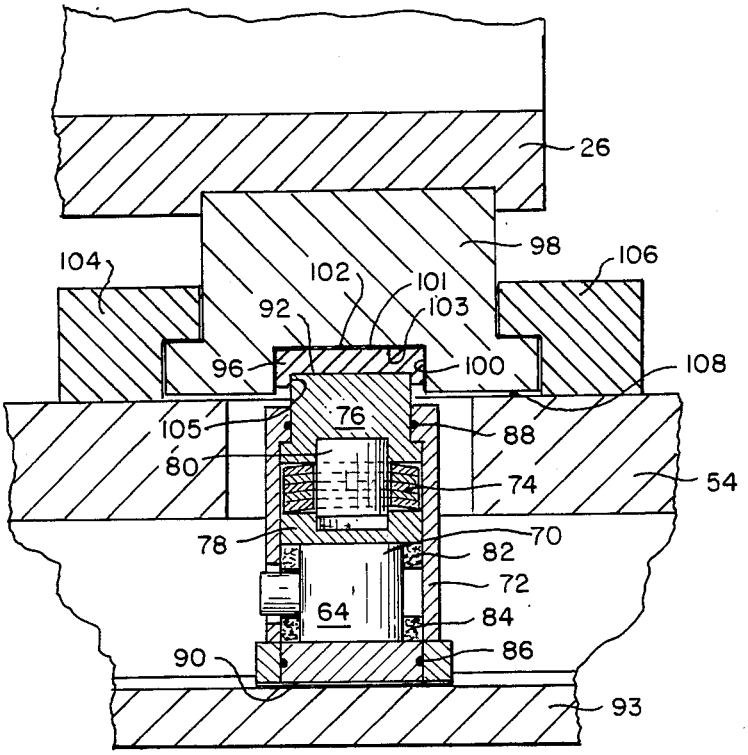
FIG. 2 is a section taken at II—II of FIG. 1.
Figure 3:
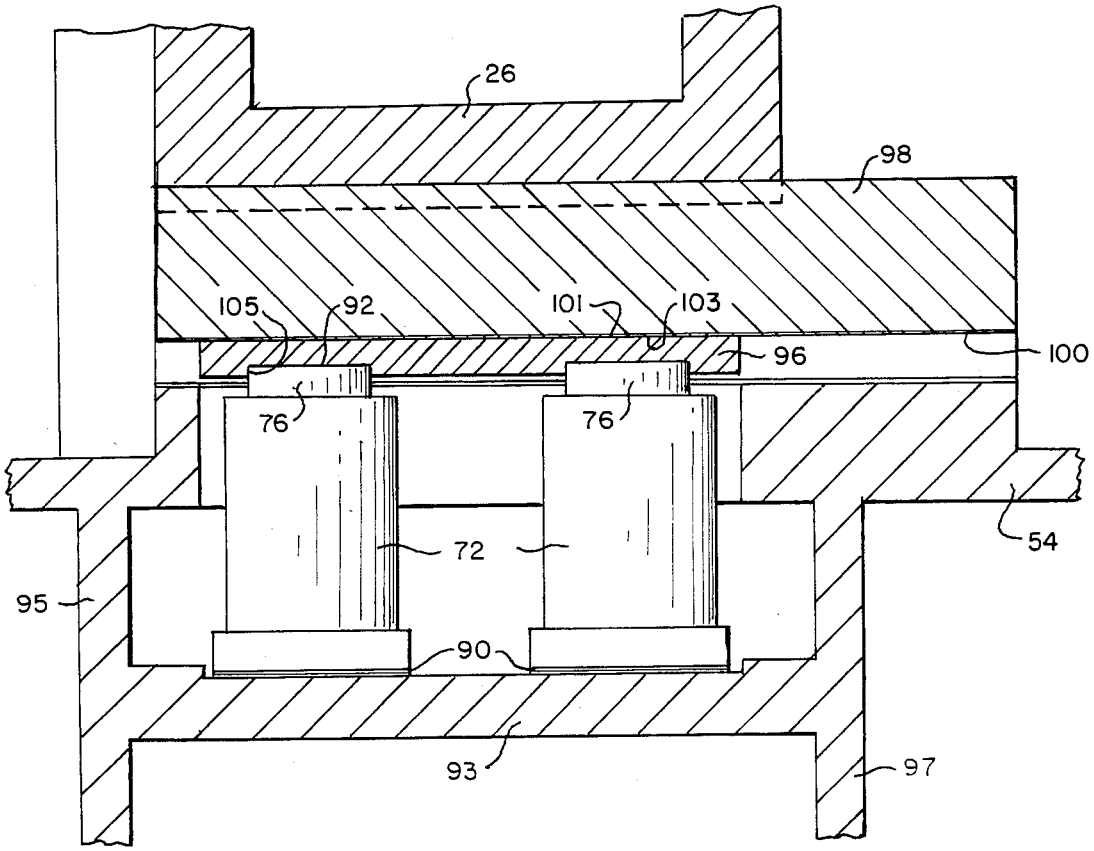
FIG. 3 is a section taken at III—III of FIG. 1.

Referring to FIG. 1, a conventional continuous caster mold assembly includes a rectangular continuous caster mold 10. Mold 10 includes a pair of broad mold walls 12 and 14 and a pair of narrow mold walls 16 and 18. Each mold wall includes a face plate 20 of copper alloy material containing water cooling passages, a steel inner support plate 22 bolted to the face plate and a steel outer support plate 24 secured to the inner plate. Outer support plate 24 of each broad mold wall forms part of water box 26 adapted to receive a supply of cooling water through flexible hoses 28 and 30 connecting each water box to mold support frame 32. Outer support plate 24 of each narrow mold wall is secured to narrow wall spacing and taper adjustment mechanism 34 for adjusting the width of a rectangular slab to be cast in the mold. Each mechanism 34 is adapted for adjustment of the spacing and angle of tilt of the respective narrow wall to which it is attached so that the aforementioned adjustments may be made during the casting operation. Two clamping mechanisms 36 and 38 are provided for adjustably clamping movable broad wall 14 against narrow mold walls 16 and 18 which in turn bear against fixed broad mold wall 12. Each clamping mechanism includes gear motor 40 coupled to screwjack 42 which drives jackstem 44. A spring assembly 46 is provided for biasing broad mold wall 14 against narrow mold walls 16 and 18 as just mentioned. Mold support frame 32 includes cross members 50 secured to vertical post members 52 and table structure 54. Friction force measuring means 56, 58, 60 and 62 are located adjacent to each of the opposed ends of broad mold walls 12 and 14 and mounted between said broad mold walls and table structure 54 of mold support frame 32. According to this invention, each friction force measuring means includes a set of at least two load cells 64 and 66 spaced apart in a horizontal direction. Preferably, the load cells are spaced apart in a horizontal direction perpendicular to the plane of each broad mold wall as illustrated in FIG. 1. Desirably, each load cell is of the compression type, see load cell 64 (FIG. 2) which is adapted to measure forces exerted vertically in an axial direction on upper surface 70 of the cell. Load cell 64 is mounted in a tubular housing 72. Belleville spring washers 74 are mounted between retainer 76 and offset washer 78 to absorb the shock of impact forces and prevent damage to load cell 64. A cylindrical guide 80 is provided within the bore of washers 74. Packing rings 82 and 84 are provided to keep water out. Additionally, seal rings 86 and 88 also serve to keep foreign matter from entering the housing. Together, offset washer 78, spring washers 74 and retainer 76 comprise a member associated with the load cell and which is variably deflectable in a vertical direction. Shims 90 are provided to adjust the spacing between an upper surface 92 of retainer 76 and sub-floor plate 93 on which housing 72 is mounted. Sub-floor plate 93 is secured to sideplates 95 and 97 which, in turn, are secured to table 54. Means are provided for guiding slidable movement of the opposed broad mold walls with respect to the frame and include a guide member 96 (FIGS. 2 and 3) mounted on the variably deflectable members of the load cells in each set and track means 98 mounted in a recess of a lower surface of water box 26, the track means having an elongated slot 100 for guiding slidable movement of the guide member therein. Preferably, guide member 96 has a planar surface 101 slidably abutting planar surface 102 of the slot. It is also desirable that guide member 96 be non-slidably mounted on the retainer 76 associated with each of the load cells, for example, in a cylindrical bore 105 provided in the guide member. A frictionless material 102 is provided on one of each pair of adjoining surfaces of slot 100 and guide member 96. The track means may also include a pair of flanged holddown members 104 and 106 mounted and secured to table 54 to prevent twisting of the track means with respect to the spaced load cells. It is to be noted that clearance space 108 is provided between the track means and table 54 to permit relative tilting between the broad mold walls and the frame such as occurs in the event of uneven or unbalanced oscillation of the mold and the frame. Such imbalance may occur in the event that the load cells are not located equidistant from the center of gravity of broad mold walls as well as due to variation in friction forces between the solidified skin formed from the molten metal in the mold and the mold walls as well as other factors. The guide member tends to reduce the effect of lateral forces caused by such unbalanced oscillation on the load cells by sliding with respect to the load cell in response to tilting of the broad mold walls. Thus, the apparatus of this invention minimizes the effect of tilting and imbalance of the mold on vertical force indicating means so as to provide a more accurate measure of friction forces on the mold.

I claim:

1. A continuous caster mold assembly comprising:

a continuous caster mold, having a mold cavity open at top and bottom ends thereof, a frame for support of said mold, said mold and frame being oscillatable in unison in a direction of casting, and a plurality of vertical force indicating means for indicating the vertical forces exerted by the mold on said frame during the oscillation thereof, including at least first and second vertical force indicating means mounted on a first of two adjoining downwardly and upwardly facing surfaces of opposed walls of the mold and the frame for bearing the load therebetween, each of said first and second vertical force indicating means including a set of at least two load cells spaced in a horizontal direction, said load cells each having an elongated member associated therewith adapted for variable deflection in a vertical direction, and means mounted on a second of said two facing surfaces for guiding slidable movement of said opposed walls with respect to the frame in said horizontal direction during oscillation of said mold, said means for guiding slidable movement including track means and a horizontal guide member mounted on the variably deflectable member of the load cells in each set so as to cause vertical deflection of said variably deflectable members, said guide member being slidably movable in the track means in said horizontal direction, said track means being adapted to permit relative tilting of the mold and said frame due to imbalance in oscillation of the mold during casting, said guide member serving to reduce the effect of lateral forces due to such imbalance and more accurately transmit vertical forces to the load cells in each set thereof.

2. The continuous caster mold assembly of claim 1 whrein the variably deflectable member associated with each load cell extends axially in a vertical direction.

3. The continuous caster mold assembly of claim 2 wherein said guide member is non-slidably mounted on the variably deflectable member of the load cells in each set thereof.

4. The continuous caster mold assembly of claim 3 wherein said track means and said guide member have adjoining horizontal planar surfaces which permit slidable movement of the guide member in said horizontal direction in the track means.

5. The continuous caster mold assembly of claim 3 further comprising resilient means associated with each variably deflectable member for reducing the impact of sudden vertical forces on said load cells.

6. A continuous caster mold assembly comprising:

a rectangular continuous caster mold having opposed paris of broad and narrow mold walls and a mold cavity open at top and bottom ends thereof, a frame for support of said mold, said mold and said frame being oscillatable in unison in a direction of casting, and a plurality of vertical force indicating means for indicating the vertical forces exerted by the mold on said frame during the oscillation thereof, including at least four vertical force indicating means, two located between each broad mold wall and the frame adjacent to opposed ends of the broad mold walls, said vertical force indicating means being mounted on a first of two adjoining downwardly and upwardly facing surfaces of said broad walls and the frame for bearing the load therebetween, each of said vertical force indicating means including a set of at least two load cells spaced in a horizontal direction substantially perpendicular to the plane of said broad mold walls, and means mounted on a second of said facing surfaces for guiding slidable movement of the broad mold walls in said horizontal direction during oscillation of the mold, said load cells each having an elongated member associated therewith adapted for variable deflection in a vertical direction, said means for guiding slidable movement including track means and a horizontal guide member mounted on the variably deflectable members of the load cells in each set so as to cause vertical deflection of said variably deflectable members, said guide member being slidably movable in the track means in said horizontal direction, said track means being adapted to permit relative tilting of the mold and said frame due to imbalance in oscillation of the mold during casting, said guide member serving to reduce the effect of lateral forces due to such imbalance and more accurately transmit vertical forces to the load cells in each set thereof.

7. The continuous caster mold assembly of claim 6 wherein the variably deflectable member associated with each load cell extends axially in a vertical direction.

8. The continuous caster mold assembly of claim 7 wherein said guide member is non-slidably mounted on the variably deflectable member of the load cell in each set thereof.

9. The continuous caster mold assembly of claim 8 wherein said track means and said guide member have adjoining horizontal planar surfaces which permit slidable movement of the guide member in said horizontal direction in the track means.

10. The continuous caster mold assembly of claim 8 further comprising resilient means associated with each variably deflectable member for reducing the impact of sudden vertical forces on said load cells.

11. The continuous caster mold assembly of claim 6 wherein said mold includes a pair of opposed narrow walls adjustably spaced between said broad walls, and means for adjustably clamping the narrow walls between the opposed broad walls of the mold.

12. The continuous caster mold assembly of claim 11 wherein said broad walls have substantially no load bearing support other than said vertical force indicating means.

13. A continuous caster mold load indicating apparatus for use in a continuous caster mold assembly of the type including a continuous caster mold having a mold cavity open at top and bottom ends thereof, a frame for support of said mold, said mold and said frame being oscillatable in unison in a direction of casting, said load indicating apparatus including a plurality of vertical force indicating means for indicating the vertical forces exerted by the mold on said frame during the oscillation thereof, including at least first and second vertical force indicating means each adapted to be mounted on a first of two adjoining downwardly and upwardly facing surfaces of said opposed mold walls and the frame for bearing the load therebetween, each said first and second vertical force indicating means including a set of at least two load cells adapted to be mounted at spaced horizontal locations, said load cells each having an elongated member associated therewith adapted for variable deflection in a vertical direction, and means adapted to be mounted on a second of said two facing surfaces for guiding slidable movement of said opposed walls with respect to the frame in said horizontal direction during oscillation of said mold, said means for guiding slidable movement including track means and a horizontal guide member mounted on the variably deflectable member of the load cells in each set so as to cause vertical deflection of said variably deflectable members, said guide member being slidably movable in the track means in said horizontal direction, said track means being adapted to permit relative tilting of the mold and said frame due to imbalance in oscillation of the mold during casting, said guide member serving to reduce the effect of lateral forces due to such imbalance and more accurately transmit vertical forces to the load cells in each set thereof.

14. The load indicating apparatus of claim 13 wherein the variably deflectable member associated with each load cell extends axially in a vertical direction.

15. The load indicating apparatus of claim 14 wherein said guide member is non-slidably mounted on the variably deflectable member of the load cell in each set thereof.

16. The load indicating apparatus of claim 15 further comprising resilient means associated with each variably deflectable member for reducing the impact of sudden vertical forces on said load cells.

* * * * *